United States Patent [19]

Koch, II

[11] 4,216,592

[45] Aug. 12, 1980

[54] DRYING OVEN

[75] Inventor: Robert L. Koch, II, Evansville, Ind.

[73] Assignee: George Koch Sons, Inc., Evansville, Ind.

[21] Appl. No.: 942,598

[22] Filed: Sep. 15, 1978

[51] Int. Cl.[2] ..... F26B 13/02

[52] U.S. Cl. ..... 34/68; 34/86; 34/160; 34/224

[58] Field of Search ..... 34/4, 18, 41, 60, 72, 34/86, 155, 160, 216, 224, 225, 219, 232, 233, 68

[56] References Cited

U.S. PATENT DOCUMENTS

| | | | |
|---|---|---|---|
| 1,752,857 | 4/1930 | Seede | 34/86 X |
| 2,184,473 | 12/1939 | Scanlan | 34/225 X |
| 2,674,811 | 4/1954 | Thornburg | 34/224 X |
| 2,679,115 | 5/1954 | Bogaty et al. | 34/225 |
| 2,731,732 | 1/1956 | Harris, Jr. et al. | 34/68 X |
| 3,403,454 | 10/1968 | Smith, Jr. | 34/68 |
| 3,999,306 | 12/1976 | Koch et al. | 34/216 X |
| 4,127,945 | 12/1978 | Nöthen et al. | 34/60 X |

FOREIGN PATENT DOCUMENTS

| | | | |
|---|---|---|---|
| 77270 | 8/1950 | Norway | 34/225 |
| 1422848 | 1/1976 | United Kingdom | 34/4 |

*Primary Examiner*—Edward G. Favors
*Assistant Examiner*—Harold Joyce
*Attorney, Agent, or Firm*—Jenkins, Coffey, Hyland, Badger & Conard

[57] ABSTRACT

An oven for curing coatings on articles removes the volatile components of the coating by a heated circulated atmosphere directed at high velocity at the coated articles and increasing in temperature between the entrance and the exit of the articles from the oven. Prior to their exit from the oven, the coated articles are exposed to infrared radiation in relatively still air to effect the final curing of the coating. The oven enclosure includes an open portion and a ducted portion. The ducted and open portions of the oven enclosure and the heating means are arranged to contribute to the effective use of energy. Within the ducted portion is a removable fan means supported and driven from outside of the oven enclosure. The ducted portion of the oven communicates with an exhaust opening in the oven enclosure having a damper valve that can be automatically controlled to permit exhaust when the level of the volatile coating material components in the oven atmosphere exceeds a preset amount. Adjacent the exhaust opening is an inlet opening in the open portion of the oven enclosure to permit incoming fresh air to make up the exhausted oven atmosphere, and a heat exchanging means transfers heat from the exhausted oven atmosphere to the make-up air entering the oven.

10 Claims, 2 Drawing Figures

DRYING OVEN

Figure 1:
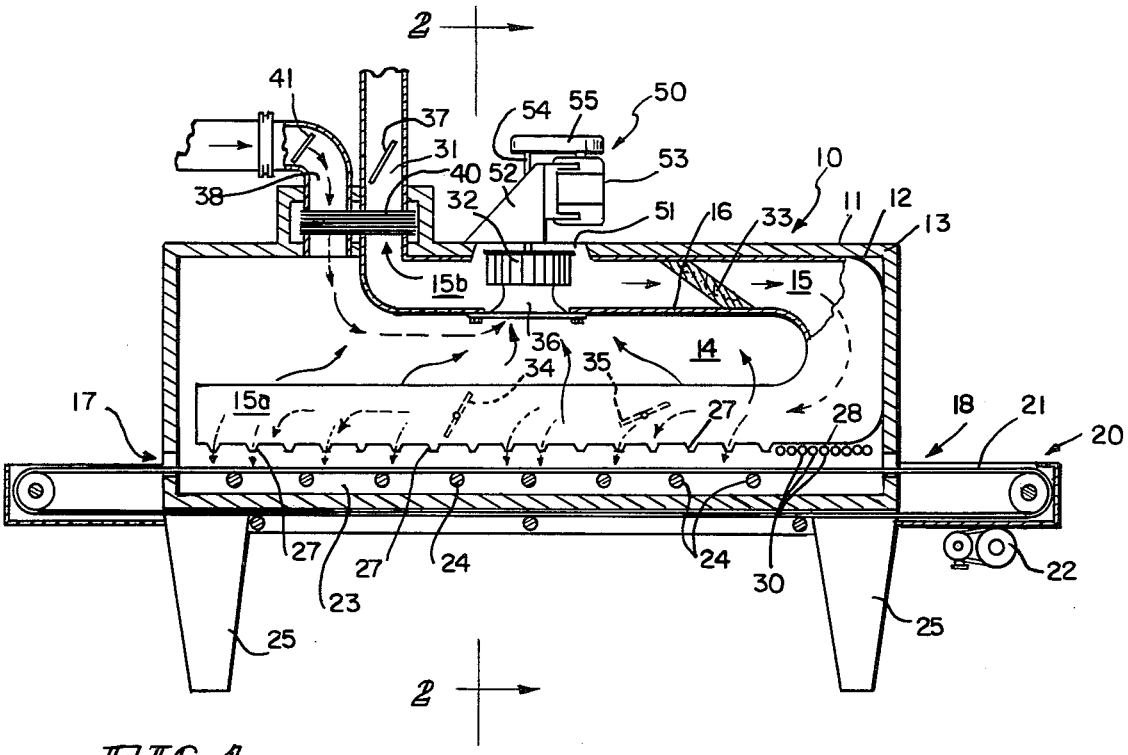

This invention relates to an improved oven to cure the coatings on articles, and particularly relates to an oven providing effective curing of coatings while conserving energy by providing an effective removal of the volatile components of coating material portions prior to curing of the coating and using radiation heating only where it is most effective, and still more particularly relates to an oven that may be easily maintained and efficiently operated.

Prior industrial ovens are known which cure coatings by directing at the coated articles high velocity jets of an atmosphere which has been raised to temperatures on the order of 220° F., or higher, by gas burners. The directed flow of hot oven atmosphere is intended to simultaneously remove the volatile portions of the coating material and to raise and maintain the coating material at its curing temperature as it passes through the oven. In curing a four feet wide, wet coating of 1.25 mils of a typical water-base filler coating on hard board at a rate of the product moving through the oven of 100 feet per minute, such ovens can provide curing in 15 seconds but require energy input on the order of about 380,000 BTUs per hour and an oven structure approximately 25 feet in length to permit complete curing of coating on 4 feet wide sheets.

Ovens using relatively low intensity infrared heating, for example, about 1 kilowatt per square foot of oven area, are also known. In curing a wet coating of 1.25 mils of typical water-base filler coating on hard board at a rate of 100 feet per minute, such low intensity infrared ovens would require 20 seconds to cure the coating and an oven structure approximately 33 feet in length, and would require an energy input of about 450,000 BTUs per hour for sheets 4 feet wide.

Ovens using high intensity infrared, for example, in excess of 14 kilowatts per square foot of oven area, are also known. In curing a wet coating of 1.25 mils of a typical water-base filler coating on hard board at a rate of 100 feet per minute, such high intensity infrared ovens would require 2.4 seconds to cure the coating and a structure approximately 4 feet in length and an energy input on the order of over 500,000 BTUs per hour for sheets 4 feet wide.

Ovens incorporating this invention provide substantially more efficient operation than the high velocity gas ovens, the low intensity infrared ovens, or the high intensity infrared ovens previously known in the art. An oven of this invention can cure a four feet wide, wet coating of 1.25 mils of a typical water-base filler coating on hard board at 100 feet per minute with an energy input on the order of 85,000 BTUs per hour for 4 feet wide sheets and can provide curing of such a coating in about 6 seconds and within a structure of a structure of approximately 10 feet in length. Ovens of this invention can eliminate the need for, or greatly reduce the consumption of, gas, which is in scarce supply. Because of their effectiveness and efficiency of the operation, ovens of this invention can provide operating costs that are less than other gas-fired ovens of comparable curing capacity and a significantly reduced capital cost. Thus use of the invention in curing ovens provides a striking reduction in the energy needed to cure industrial coatings, eliminates or decreases the need for increasingly scarce heating gas and provides an oven structure which uses little floor space and a significantly reduced overall capital investment compared with prior ovens.

In addition, ovens of this invention may be easily operated in compliance with government regulations regarding air pollution in that the solvents from the coatings cured within the oven do not come in contact with flame.

In the invention, a plurality of coated articles to be cured are carried through the oven. The time of passage between the entrance into the oven and the exit from the oven and the energy input are adjusted to permit complete curing of the coating on the article. In passing from the entrance to the exit of the oven, the articles are exposed to high velocity jets of oven atmosphere that are directed at the coated articles within the oven enclosure. The circulation of oven atmosphere within the oven enclosure is controlled to produce a temperature gradient in the atmosphere directed at the articles with the temperature of the directed oven atmosphere increasing as the coated articles are carried from the entrance to the exit of the oven, thus providing a controlled removal of any volatile portions of the coating. Just prior to exit from the oven, the coatings on the articles are exposed to infrared radiation to cure the coatings which have been depleted to their volatile portions by exposure to the high velocity jets of increasing temperature. As the oven atmosphere increases in its percentage of volatile components of the coating material, portions of the oven atmosphere are exhausted and replaced by fresh air which has been preheated by transferring heat from the exhausted oven atmosphere to the incoming make-up air.

An oven of the invention comprises an enclosure permitting entrance and exit of the coated articles and defining within its interior an open oven portion and a ducted oven portion for controlled circulation of the oven atmosphere. Means, such as a conveyor, are provided for moving the coated articles over a defined path through the open portion of the oven enclosure. The oven includes means, such as a fan or blower means, within the ducted portion of the oven to circulate the oven atmosphere from the open portion into and through the ducted portion of the oven to be directed at the coated articles as they pass through the oven. Heating means, such as steam coils or electric coils, can be placed inside of the ducted portion to heat the oven atmosphere moving therethrough. The ducted portion includes a portion adjacent the defined path of movement of the coated articles, with such portion having a plurality of openings to direct the circulated atmosphere of oven at the coated articles as they travel along a defined path between the entrance and exit of the oven enclosure. Infrared heating means are generally provided in the open portion of the oven enclosure adjacent the path of the coated articles and the exit from the oven enclosure. Such infrared heating means raise the temperature of the coating on the articles and cures the coating prior to its exit from the oven. The ducted portion of the oven can enclose a substantial portion of the oven enclosure adjacent the oven exit and thus substantially prevent circulation of the oven atmosphere in the open portion of the oven adjacent the oven exit where such infrared heating means are provided.

Such infrared heating means can also heat the ducted portion of the oven enclosure adjacent the oven exit, and the means providing movement of the oven atmosphere through the duct can move the circulated atmosphere into a heat transfer relationship with the heated portion of the duct before being directed from the duct at the coated articles. Such an arrangement can provide a temperature increase in the oven atmosphere directed at the coated articles as they move between the entrance and the exit of the oven enclosure, providing controlled increase in coating temperature and a controlled release of any volatile coating portions. In addition, the wall of the ducted portion adjacent the oven exit can reflect a portion of the infrared radiation to the coated articles to increase its effectiveness.

The ducted portion of such an oven can be in communication with an exhaust opening in the oven enclosure, and the open portion of the oven enclosure can include an oven inlet opening for make-up air. The ducted portion of the oven can form a plenum between the exhaust opening and the fan means. The exhaust opening can include a controllable damper valve to permit the automatic exhaust, from the ducted portion of the oven, of a portion of the oven atmosphere. An inward flow of fresh air to make up the exhausted portion of the oven atmosphere will occur through oven inlet opening into the open portion of the oven. Oven controls can provide such exhaust and the make up of oven atmosphere when the volatile portion of the coating material carried within the oven atmosphere exceeds a preset level. The opening in the oven enclosure for the exhaust of oven atmosphere and the opening in the oven enclosure for the make-up air can be adjacent, and a heat exchanger can be included in the oven to remove heat from the exhausted oven atmosphere and transfer such heat to the make-up air entering the oven, thus recovering otherwise lost oven heat.

This invention also includes a self-contained, reliable, easily maintainable and easily replaceable means to circulate the oven atmosphere. Such means includes a fan within the ducted portion of the oven enclosure which is rotatably carried and supported by bearings mounted outside of the heated oven enclosure. The shaft on which the fan is carried is driven by a motor also mounted outside of the oven enclosure. The fan can be inserted into the ducted portion of the oven through an access opening in the oven enclosure. Adjacent to this access opening, an opening can be formed in a wall of the ducted portion of the oven, which is adapted to serve as an inlet to the fan. Such an opening permits the fan to move the oven atmosphere from the open portion into and through the ducted portion of the oven. The access opening in the oven enclosure through which the fan is inserted is closed by a removable cover.

The invention can comprise an insulated oven enclosure having an entrance opening and an exit opening for coated articles on a conveyor. The interior of the oven enclosure is partitioned to create an open oven portion and a ducted portion for controlled circulation of the oven atmosphere within the oven enclosure. A removable fan means is mounted in the duct work, and the duct work is adapted adjacent the fan means to provide an inlet to the fan means so that it may draw the oven atmosphere from the open oven portion into the ducted portion of the oven. Between the exhaust opening of the oven enclosure and the fan means, the ducted portion forms a plenum-like passageway, and the ducted portion of the oven also leads from the fan means to adjacent the conveyor path. The wall of the ducted portion adjacent the conveyor path of the articles can be heated by the infrared radiation source adjacent the exit end of the oven and includes a plurality of openings to direct jets of heated oven atmosphere from the duct work at the articles as they pass through the oven on the conveyor to remove the volatile portion of the coating. As these volatile components increase within the oven atmosphere, a controllable damper is actuated permitting the exhaust of oven atmosphere by the fan means from the ducted portion of the oven. An inlet opening for make-up air admits fresh air into the open portion of the oven as the oven atmosphere is exhausted. Because of the arrangement of the openings and the duct work, substantial fresh make-up air is drawn into the open portion of the oven before reaching the oven exhaust opening, permitting the controls to maintain the volatile content of the oven atmosphere below a preset level, most typically selected to be below the lower explosive limit for the materials forming the volatile portion of the coating material.

Figure 2:
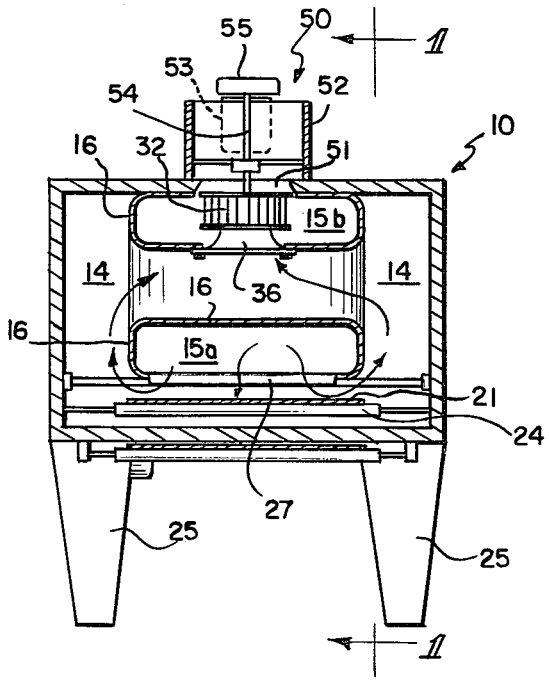

Further features and advantages of the invention will be apparent from the following description and drawings in which:

FIG. 1 is a cross-sectional view of an oven of this invention taken on line 1—1 of FIG. 2; and FIG. 2 is a cross-sectional view of the oven of FIG. 1 along line 2—2 of FIG. 1.

Moving a high volume of warm air at high velocity over a surface is the fastest and most efficient technique known for removing volatiles from liquid coatings. To dry most coatings, their volatile components must pass from the coating to outside air that is adjacent to the coating. Without a high volume of high velocity air movement, this adjacent air soon becomes heavily saturated with the volatile materials, and additional solvent or volatile component removal becomes slow and ineffective. Although the oven atmosphere is from time to time referred to as "air" it is to be understood that such references are to oven atmosphere containing volatile coating material components.

When exposed to a movement of oven atmosphere at both high volume and high velocity, stagnation of air that has become saturated with volatile solvents cannot occur adjacent the articles. The volume of moving heated gas provides removal of the volatile coating material components on a continuous basis. It is desirable that the high volume, high velocity oven atmosphere be heated to overcome the cooling action of the evaporating volatile solvents and to increase the evaporation of such volatile materials by the addition of heat to the coatings. Generally, volatile materials can be effectively driven from coatings, for example, by a relatively unsaturated oven atmosphere at temperatures on the order of 180° F. directed at the coated articles at 6000 feet per minute. The quantity of such air needed depends, of course, upon the quantity of coating material from which the volatile solvents are evaporating.

Such high velocity air is directed at coated articles as they enter ovens of this invention with the temperature, velocity, and volume of the circulated air being gradually increased as the coated article approaches the oven exit. Adjacent the exit of the oven, infrared heating can be used in relatively stagnant air for maximum heating of the coating on the article and final curing.

The embodiment of the invention illustrated in FIG. 1 includes an oven enclosure 10 formed from exterior panels 11 of precoated 20 gauge steel and interior panels 12 of 22 gauge aluminized steel, with insulation such as four pound density, non-settling glass fibers between the exterior and interior panels to minimize heat loss from the oven. The interior of the oven enclosure 10 is divided into an open portion 14 and a ducted portion 15 by interior wall means 16 comprised, for example, of 16 gauge cold rolled steel sheeting.

The oven enclosure 10 includes an entrance opening 17 and an exit opening 18. Means 20 defines a path for coated articles between the entrance 17 and the exit 18 of the oven enclosure 10. Means 20 shown in FIG. 1 and FIG. 2 comprises a conveyor belt 21 driven by a variable speed transport conveyor drive 22 over idlers 24. Sufficient time of passage of coated articles is provided between the entrance 17 and the exit 18 of the oven enclosure to permit complete curing of the coating. Although FIG. 1 and FIG. 2 show a belt conveyor, other conveyor means, such as overhead chain conveyors, may be used where the oven is adapted to cure coated articles so carried. A relieved area 23 is provided in the oven enclosure under the belt 21 to insure positive conveying of lightweight sheets through the oven.

The oven enclosure 10 may be provided with doors (not shown) along the sides to provide easy access to the inside of the oven. In addition, the oven may be constructed with flashing on all joints between the oven panels to minimize the heat loss from the oven. Any convenient base, such as the legs 25 shown in FIG. 1 and FIG. 2, may be provided to support the oven and to adjust the conveyor means to make with other processing equipment upstream and downstream from the oven.

As shown in FIG. 1 and FIG. 2, the ducted portion 16 within the oven enclosure 10 can extend from adjacent the top of the oven enclosure 11 to adjacent and along the directed path for the coated articles defined by conveyor belt 21. The ducted portion 15 includes portion 15*a* terminating adjacent the entrance 17 to the oven enclosure 10 as shown in FIG. 1 and extending along and immediately above the path of the coated articles defined by conveyor belt 21 from adjacent the entrance 17 of the oven to the exit 18 of the oven. The ducted portion 15*a* of the oven includes a wall 26 immediately adjacent the path of the coated articles and including a plurality of openings 27 which are formed to create a plurality of jets of air moving at relatively high velocity, for example, on the order of 6000 feet per minute, and directed at the coating on the articles. The openings 27 in wall 26 may be formed in any convenient manner; however, the total cross-sectional area of the plurality of openings 27 should be correlated with the capacity of the fan means creating circulation within the ducted portion of the oven to obtain the velocities needed for effective removal of the vaporizing volatile portions of the coating material. The wall 26 also includes a portion 28 adjacent the exit of the oven enclosure. Infrared heaters 30 are mounted within the oven enclosure immediately adjacent the path of the coated articles just prior to their exit from the oven enclosure. The portion 28 of wall 26 is in heat transfer relationship with the infrared heaters 30, absorbing a portion of the radiation from the infrared heaters 30, thereby conducting heat to the moving atmosphere within the ducted portion of the oven, and reflecting a portion of the radiation from heaters 30 to the coating on the articles. Energy expended in heaters 30 is thereby efficiently utilized.

At the upper ducted portion of the oven enclosure the duct wall means 16 forms a plenum-like portion 15*b* of the ducted portion of the oven between an exhaust opening 31 in the oven enclosure and fan means 32. In addition to the infrared heating means 30, steam coils or electric heating means 33 can be provided within the ducted portion of the oven to heat the circulating oven atmosphere as to aid in faster removal of higher boiling point volatiles as needed.

When fan means 32 is in operation, the oven atmosphere is forced to flow through the ducted portion 15 of the oven past the heating means 33 and in heat transfer relationship with portion 28 of wall 26, and is directed from portion 15*a* of the ducted portion of the oven through openings 27 at coated articles as they are transported through the oven enclosure from entrance 17 to exit 18. In operation the temperature of the high velocity jets from openings 27 will be higher adjacent the exit end 18 of the oven enclosure than it is adjacent the entrance end 17 of the oven enclosure. Dampers 34 and 35 may be provided within the portion 15*a* of the ducted portion of the oven to provide additional control of the velocity and temperature of the high velocity jets impinging upon the coating. Coated articles entering the oven enclosure experience an effective removal of the volatile portion of the coating.

The velocity and temperature of the oven atmosphere impinging upon the coating is preferably controlled so that vaporization of the volatile materials of the coating is completed by the time the article reaches the infrared heating means 30. As the coated articles pass through the radiation from infrared heating means 30, the temperature of the coating is raised sufficiently to complete its curing. Heating means 30 is located adjacent the exit end of the oven enclosure directly beneath the end of the ducted portion 15 above wall portion 28 in an area of low air movement within the oven enclosure, thus minimizing any cooling effect circulation of the oven atmosphere might otherwise have upon the irradiated coating. The ducted portion 15 of the oven encloses a substantial portion of oven enclosure at its exit end and thus blocks circulation of oven atmosphere in the open portion of the oven adjacent its exit end. Curing of the coating is thus completed by infrared heaters 30 beneath this portion of the duct work in an area without substantial circulation.

As shown in FIG. 1 and FIG. 2, the oven atmosphere after impingement upon the coated article is directed into the open portion 14 of the oven enclosure 10 carrying with it any volatile portions from the coating on the articles being cured. An opening 36 in the wall means 16 is formed to provide an inlet to the blower means 32 and circulation of the oven atmosphere within the oven.

The oven may be provided with an automatic control to permit the exhaust of oven atmosphere if the percentage of volatile materials or solvents in the oven atmosphere reaches a preset level. Such an automatic control is typically set to operate at a level well below that required for effective operation of the oven and can open a damper 37 that controls the exhaust from opening 31 of the oven enclosure. When damper 37 is opened, the fan means 32 forces a portion of the oven atmosphere through the portion 15*b* of the ducted portion of the oven outwardly through the exhaust opening 31. Make-up air for the exhausted portion of the oven atmosphere is permitted to enter the oven enclosure through oven inlet opening 38 in the oven enclosure, and a flow of fresh air is brought into the open portion 14 of the oven enclosure by the action of fan means 32. If desired, a damper 41 can be placed in the inlet opening of the oven enclosure to control the make-up air drawn into the oven.

A heat exchanger 40 may be mounted between the exhaust opening 31 and the inlet opening 38 of the oven enclosure so that one portion of the heat exchanger is exposed to the heated oven exhaust and the heat exchanger operates to transfer heat from the oven exhaust to the fresh air entering the oven through opening 38. This arrangement conserves the energy expended within the oven.

A particularly important feature of the invention is a self-contained, easily serviceable means, such as fan 32, to circulate the oven atmosphere within the oven enclosure 10 as shown in FIG. 1 and FIG. 2. Such means includes a unit 50 which may be mounted on top of the oven enclosure 10. The unit 50 can include a centrifugal blower or fan 32 which extends through an access opening 51 in the oven enclosure. The unit includes a mounting structure 52 to support a motor 53, and a rotating shaft 54 on which the fan 32 is rotatably carried and supported. The structure 52 provides a support for any bearings necessary to carry the fan 32. The frame 52 also carries means 55, which may be gears or, preferably, pulley means, coupling the shaft of motor 53 to the rotating shaft 54 which drives the fan 32. The frame 52 also includes a plate to cover access opening 51. As shown in FIG. 1 and FIG. 2, the access opening 51 of the open oven enclosure can be adjacent the portion 36 of wall means 16 which is adapted to provide the inlet to the centrifugal blower 32. Thus, the motor and bearings for the means to provide circulation within the oven are located entirely outside the oven enclosure where they are not exposed to the elevated temperatures within the oven enclosure, substantially increasing the reliability of the fan drive. Furthermore, location outside the oven enclosure permits access for maintenance and lubrication which is periodically required. Since the blower means 32 is the only significant moving part of the oven shown in FIG. 1 and FIG. 2, it may be easily replaced for servicing requiring little or no down time during production.

In addition, where desirable removal of the exhaust oven atmosphere from the oven may be assisted by a separate fan in the exhaust rather than being achieved solely by the main circulating fan.

It should be understood that the preferred embodiment of the invention shown and described above is capable of many modifications. Changes therefore, in the construction and arrangement, may be made without departing from the spirit and scope of the invention as disclosed in the following claims.

I claim:

1. An oven for curing the coating of an article comprising:

an oven enclosure providing an entrance and exit for coated articles and defining an open oven portion and a ducted portion for controlled circulation of the oven atmosphere;

means for moving the coated articles over a defined path through the open portion of the oven enclosure;

means within the ducted portion of the oven to circulate the oven atmosphere from the open portion into, through, and out of the ducted portion of the oven enclosure;

means for heating the atmosphere within the ducted portion;

said ducted portion including a wall adjacent the defined path of movement of the coated article, said wall having a plurality of openings to direct the circulated atmosphere of the oven at the coated articles moving along the defined path from adjacent said entrance to adjacent said exit from the oven enclosure; and said ducted portion of the oven including an exhaust opening, and said open portion of the oven including an oven inlet opening for make-up air in the oven enclosure with a heat exchanger between the exhaust opening and the oven inlet opening, said exhaust opening including a controllable damper valve to permit automatic exhaust of a portion of the oven atmosphere when the volatile portion of the coating material in the oven atmosphere exceeds a preset level, said circulating means creating a flow of oven atmosphere out of the exhaust opening and a flow of fresh air into the oven enclosure to make up the exhausted portion of the oven atmosphere.

2. The oven as set forth in claim 1 wherein the exhaust opening and the oven inlet opening are adjacent and a heat exchanger is carried in communication with the exhausted oven atmosphere and with the oven make-up air and transfers heat from the exhausted oven atmosphere to the oven make-up air.

3. An oven for curing the coating of an article comprising:

an oven enclosure providing an entrance and exit for coated articles and defining an open oven portion and a ducted portion for controlled circulation of the oven atmosphere;

means for moving the coated articles over a defined path through the open portion of the oven enclosure;

means within the ducted portion of the oven to circulate the oven atmosphere from the open portion into, through, and out of the ducted portion of the oven enclosure;

said ducted portion of the oven including an exhaust opening in the oven enclosure and said open portion of the oven including an oven inlet opening for make-up air in the oven enclosure;

means for heating the atmosphere within the ducted portion;

said ducted portion including a wall adjacent the defined path of movement of the coated article, said wall having a plurality of openings to direct the circulated atmosphere of the oven at the coated articles moving along the defined path from adjacent said entrance to adjacent said exit from the oven enclosure;

said ducted portion further enclosing a substantial portion of the oven enclosure adjacent the oven exit; and infrared heating means in the open portion of the oven enclosure adjacent the defined path for the coated article and beneath the wall of the ducted portion adjacent the oven exit.

4. An oven for curing the coating of an article comprising:

an oven enclosure providing an entrance and exit for coated articles and defining an open oven portion and a ducted portion for controlled circulation of the oven atmosphere;

means for moving the coated articles over a defined path through the open portion of the oven enclosure;

fan means within the ducted portion of the oven to circulate the oven atmosphere from the open portion into, through, and out of the ducted portion of the oven enclosure, said fan means being rotatably supported and driven by motive means outside of the oven enclosure and removably carried by the oven enclosure within the ducted portion of the oven through an access opening in the oven enclosure;

said ducted portion including a wall adjacent the defined path of movement of the coated article, said wall having a plurality of openings to direct the circulated atmosphere of the oven at the coated article along the defined path from adjacent said entrance to adjacent said exit from the oven enclosure, said ducted portion further being positioned in a substantial portion of the oven enclosure adjacent the oven exit to substantially block circulation in the open portion of the oven adjacent the oven exit; and means for heating the atmosphere within the ducted portion before it is directed from said wall openings, said heating means including infrared heating means in the open portion of the oven enclosure beneath the ducted portion adjacent the oven exit to heat a portion of said wall of the ducted portion and said fan means moving the atmosphere into heat transfer relationship with said heated portion of the wall before it is directed from said wall openings.

5. An oven for curing the coating of an article comprising:

an oven enclosure permitting entrance and exit of a coated article and defining an open oven portion and an oven inlet opening in communication with said open portion, and further defining a ducted portion for controlled circulation of the oven atmosphere and an oven exhaust opening in communication with said ducted portion;

means for moving the coated article over a defined path through the open portion of the oven enclosure;

fan means within the ducted portion of the oven to circulate the oven atmosphere within the open portion and the ducted portion of the oven enclosure, said fan means also exhausting a portion of the oven atmosphere through the oven exhaust opening and bringing fresh make-up air into the oven through said oven inlet opening;

a heat exchanger in communication with the exhausted oven atmosphere and with the make-up air to transfer heat from the exhausted oven atmosphere to the make-up air;

said ducted portion including a wall adjacent the defined path of movement of the coated article, said wall having a plurality of openings to direct the circulated atmosphere of the oven at the coated article along the defined path from adjacent its entrance to adjacent its exit from the oven enclosure, said ducted portion further being positioned in a substantial portion of the oven enclosure adjacent the oven exit to substantially block circulation in the open portion of the oven adjacent the oven exit; and infrared heating means in the open portion of the oven enclosure adjacent the defined path for the coated article and beneath the ducted portion adjacent the oven exit to raise the temperature of the coating of the article by radiation heating in the absence of significant circulation;

said infrared heating means also heating a portion of said wall of the ducted and said fan means moving the atmosphere into heat transfer relationship with said heated portion of the wall before it is directed from said wall openings.

6. A curing oven comprising an oven enclosure, a source of heat within the oven enclosure, means to circulate and exhaust the oven atmosphere and to provide a flow of make-up air into the oven enclosure, a duct work within the oven enclosure to direct a circulation of the oven atmosphere, said means to circulate and exhaust the oven atmosphere and to provide a flow of make-up air into the oven enclosure comprising a single blower carried within the duct work, a conveyor means defining a path for carrying articles through the oven enclosure between an entrance and an exit of the oven enclosure, said duct work including a wall adjacent the path of said articles within the oven enclosure from adjacent the entrance of the oven enclosure to the exit opening of the oven enclosure, the portion of said wall adjacent the exit end of the oven enclosure being heated by infrared radiation means and the remainder of said wall defining a plurality of openings to direct the circulation of oven atmosphere from within the duct work at the coated articles as they travel their defined path through the oven enclosure, said blower circulating the oven atmosphere within the duct work first past the heated wall portion then from the plurality of openings.

7. The oven as set forth in claim 6 wherein the infrared radiation means is mounted adjacent said wall portion in such a manner that radiation not directly impinging on the coated articles is reflected by said wall at said coated articles, and said duct work, including that portion of said wall adjacent the exit end of the oven, is positioned in a substantial portion of the oven enclosure adjacent the exit opening and substantially prevents significant circulation in the oven enclosure adjacent the exit opening where the infrared heating means are mounted.

8. An oven for curing the coating of an article comprising:

an oven enclosure providing an entrance and exit for coated articles and defining an open oven portion and a ducted portion for controlled circulation of the oven atmosphere, said ducted portion being defined by a wall within the oven enclosure;

means for moving the coated articles over a defined path through the open portion of the oven enclosure;

means within the ducted portion of the oven to circulate the oven atmosphere through an opening in said wall into said ducted portion and through and out of the ducted portion of the oven enclosure;

means for heating the atmosphere within the ducted portion;

said wall of said ducted portion including a wall portion adjacent the defined path of movement of the coated article, said wall portion having a plurality of openings to direct the circulated atmosphere of the oven at the coated articles moving along the defined path from adjacent said entrance to adjacent said exit from the oven enclosure;

said oven enclosure having an exhaust opening and oven inlet that are adjacent, said ducted portion of the oven being in communication with an exhaust opening in the oven enclosure, and said open portion of the oven being in communication with an oven inlet opening for make-up air in the oven enclosure;

a heat exchanger between the exhaust opening and the oven inlet openings; and said circulating means being located within the ducted portion of the oven adjacent the exhaust opening and oven inlet to create a flow of oven atmosphere out of the exhaust opening and a flow of fresh air into the oven enclosure and both of said flows through said heat exchanger.

9. The oven of claim 8 wherein the wall of the ducted portion includes a wall portion between the circulating means and the exhaust opening forming a plenum-like chamber within the ducted portion adjacent the exhaust opening, said wall opening adjacent the circulating means permitting oven atmosphere to be drawn into the ducted portion of the oven, and said circulating means and said adjacent wall opening are located to draw make-up air from the inlet opening adjacent the wall forming the plenum-like chamber, said exhaust opening including a controllable damper to permit periodic exhaust of a portion of the oven atmosphere.

10. A curing oven comprising:

an oven enclosure having an entrance opening and an exit opening;

a source of heat within the oven enclosure;

a conveyor means defining a path for carrying coated articles through the oven enclosure between the entrance and the exit;

single blower means to circulate and exhaust the oven atmosphere and to provide a flow of make-up air into the oven enclosure;

a duct work within the oven enclosure to direct a circulation of oven atmosphere, said duct work including a wall adjacent the path of said articles within the oven enclosure from adjacent the entrance opening to adjacent the exit opening of the oven enclosure;

infrared radiation means mounted adjacent to and heating a wall portion of said wall adjacent the exit opening of the oven enclosure, said infrared radiation means and said wall portion being arranged in such a manner that radiation not directly impinging on the coated articles is reflected by said wall portion at said coated articles;

said duct work including said wall portion being positioned in a substantial portion of the oven enclosure adjacent the exit opening and substantially preventing circulation in the oven enclosure adjacent the exit opening where the infrared heating means are mounted;

the remainder of said wall adjacent the path of the articles defining a plurality of openings to direct the circulation of oven atmosphere from within the duct work at the coated articles as they travel their defined path through the oven enclosure;

said blower circulating the oven atmosphere within the duct work first past the heated wall portion and then from the plurality of openings, exhausting the oven atmosphere and providing a flow of oven make-up air into the oven enclosure.

* * * * *